US008151510B2

(12) United States Patent
Capson

(10) Patent No.: US 8,151,510 B2
(45) Date of Patent: Apr. 10, 2012

(54) PARTIAL OPTICAL SIGHTING DEVICE

(76) Inventor: Ronnie Rex Capson, Blackfoot, ID (US)

( * ) Notice: Subject to any disclaimer, the term of this patent is extended or adjusted under 35 U.S.C. 154(b) by 15 days.

(21) Appl. No.: 12/862,612

(22) Filed: Aug. 24, 2010

(65) Prior Publication Data

US 2012/0047788 A1 Mar. 1, 2012

(51) Int. Cl.
*F41G 1/00* (2006.01)

(52) U.S. Cl. ..... 42/130; 42/111; 42/125

(58) Field of Classification Search ..... 42/130, 42/125, 126, 113, 111; 33/265, 297; 359/427, 359/428, 424, 362
See application file for complete search history.

(56) References Cited

U.S. PATENT DOCUMENTS 3,439,970 A * 4/1969 Rickert ..... 42/131
3,502,416 A * 3/1970 Rickert ..... 356/251
4,375,725 A * 3/1983 Orlob ..... 42/119
5,283,689 A 2/1994 Carlough
7,921,591 B1 * 4/2011 Adcock ..... 42/113
2002/0078618 A1 * 6/2002 Gaber ..... 42/123

* cited by examiner

*Primary Examiner* — Gabriel Klein
(74) *Attorney, Agent, or Firm* — Workman Nydegger

(57) ABSTRACT

Apparatus, assemblies, and methods for sighting objects disclosed. A sighting device includes a segmented optic and a reticle. The reticle is optically aligned with the segmented object and is magnified by the segmented optic. A body structure supports the segmented optic and the reticle to define an open sight construction. In another aspect, a sighting device includes a segmented object and reticle, where the reticle includes multiple distance indicia and a contrast component. A support structure supports the reticle and the segmented object for magnification of the distance indicia by the segmented optic. A segmented optic in a sighting device is cut above center or otherwise such that a partial optic is defined having a portion above and below center. In another aspect, a sight adjustment mechanism includes a threaded connector that adjusts the sight position based on a difference between coarseness of threads engaged with the threaded connector.

20 Claims, 7 Drawing Sheets

PARTIAL OPTICAL SIGHTING DEVICE

FIELD OF THE INVENTION

The present disclosure relates generally to sighting devices. More particularly, the present disclosure relates to sighting devices making use of an optical element. More particularly still, sighting devices of the present disclosure may include a partial or incomplete optical element and be used to sight any number of different objects or in a diverse set of applications.

BACKGROUND OF THE INVENTION

A variety of different types of gun sights have been widely used. Such sights have included, for instance, open sights, aperture sights, scopes, red dot sights, and laser sights. For example, a common type of open sight is a post-and-notch type sight. Such an open sight may, for instance, include a post that projects upwardly a small distance near the distal end of a gun barrel. To make use of the open sight, the post may be aligned with a notch near the proximal end of the gun, and placed on the target in the field of view.

Aperture sights are available in various varieties. One common aperture sight is a peep sight, and is particularly common on rifles. In its basic form, a peep sight generally includes two openings or holes. One opening is typically mounted near the proximal end of the rifle, and the other opening is mounted towards the distal end of the rifle. The shooter may then make use of the peep sight by aligning the two apertures so as to sight through them at the target. In some cases, an aperture sight may also include a a post or blade near the distal end of the gun barrel, and the post or blade may be aligned in the aperture at the proximal end of the gun.

Unlike open sights or aperture sights, a scope makes use of magnification to magnify the target, whereas open sights and aperture sights typically do not magnify the target. Scopes are available in a wide variety of forms, and may include different features for magnification, focus, day/night use, and the like. In a basic form, a scope makes use of an ocular lens and an objective lens. The objective lens is positioned near the distal end of the gun and controls the amount of light that can be transmitted to the ocular lens. The ocular lens is located nearer the proximal end of the gun, and is the eyepiece through which the user will look through the scope. The scope operates in essentially the same manner as a telescope, and as light passes through the objective ends it will focus on a point inside the scope. The ocular lens magnifies the light from a focal point. In viewing the image through the scope, the light is shown as an image. The scope also typically includes a crosshair reticle that can be aligned on the reflected, magnified image.

Red dot sights and laser sights are also available, and are most common in connection with governmental and military firearms. A red dot sight projects an image of the target, along with a red or other colored dot on top of the projected image. The red dot can then be aligned on a particular location of the projected image to aim the firearm. The red dot on the image is maintained within the housing of the sight, and is not projected outside the end of the sight. In contrast, a laser sight will project one or more laser beams towards a target. The red or other colored laser beam will illuminate the targeted location.

The above discussion relates generally to sights for firearms, but sights may also be used in other applications. For instance, sights may be used in archery or other firearms, or with transits, theodolites, or other types of equipment. In traditional archery bowsights, for instance, multiple aiming points may be mounted to the bow handle. A peephole or other aperture may be mounted on the bowstring. To sight the target, the archer may align the desired aiming point with the target and the peephole.

Regardless of the type of sight that has previously been employed, each sight offers various benefits and drawbacks. Open and aperture sights, for instance, are inexpensive and generally lightweight. While such sights are often suitable for targets at a short distance, open and aperture sights are widely considered to lack accuracy at large distances. Increased accuracy can, however, be accommodated with a laser sight, red dot sight, or scope. Such accuracy comes at a significant cost, however, as the sights can be very expensive. Sights having increased accuracy typically not only are very expensive, but may also be heavy, use an external power source, or be highly sensitive to lighting conditions.

Accordingly, what is desired is a sighting device that is lightweight, relatively cost-effective, and accurate at small or large distances.

BRIEF SUMMARY

Example embodiments within the present disclosure relate to sighting devices and assemblies, and related methods. Additional example embodiments of the present disclosure may relate to sighting devices, assemblies, and methods for using a partial optical component to sight a target.

According to one exemplary embodiment, a sighting device includes a segmented optic, a reticle and a body structure. The reticle is optically aligned with the segmented optic which is configured to magnify the reticle. The body structure supports the segmented optic and the reticle in an open sight configuration.

According to another exemplary embodiment, a sighting device includes a segmented optic, reticle, and support structure. The reticle includes different distance indicia and a contrast component. The support structure supports the segmented optic and the reticle such that the reticle is aligned with the segmented optic for magnification of the plurality of different distance indicia by the segmented optic.

According to another exemplary embodiment, a sighting device includes a reticle, segmented optic component, and a support structure. The segmented optic component includes a partial optic defining a portion above and below center. The support structure supports the segmented optic and the reticle such that the reticle is selectively positionable relative to the segmented optic for magnification of the reticle.

According to another exemplary embodiment, a sighting adjustment mechanism includes a sight, mounting base, and an adjustment mechanism. The sight and mounting base include threaded connectors having first and second coarsenesses. The mounting base is configured to adjustably secure the sight. The adjustment mechanism is configured to move the sight relative to the mounting base, and includes a third threaded connector. The third threaded connector is coupled to each of the first and second threaded connectors. Adjustment of the third threaded connector causes the sight to move a distance related to a difference between the first and second coarsenesses.

According to another exemplary embodiment, a method for adjusting a sighting device includes attaching a threaded fastener to a sighting device and a sight mount. Threads of the threaded fastener are engaged with threads of the sighting device and threads of the sight mount. Threads of the sighting device have a different coarseness than threads of the sight mount. At least one biasing member is attached to the sighting device and the sight mount. The at least one biasing member is placed in a stressed state by adjusting a tightness of the threaded fastener. A position of the sighting device is adjusted relative to the sight mount by adjusting a tightness of the threaded fastener such that the sighting device moves a distance related to a difference between the coarseness of the threads of the sighting device relative to a coarseness of the threads of the sight mount.

In accordance with any embodiment disclosed herein, a segmented optic is generally semi-circular.

In accordance with any embodiment disclosed herein, a segmented optic is cut above center.

In accordance with any embodiment disclosed herein, a segmented optic is cut by a manufacturing process cutting down an optic or molding an optic to the cut shape.

In accordance with any embodiment disclosed herein, a segmented optic has a triangular, pie, or wedge-shaped configuration.

In accordance with any embodiment disclosed herein, a base is coupled to the body structure.

In accordance with any embodiment disclosed herein, an adjustment mechanism is coupled to a body structure.

In accordance with any embodiment disclosed herein, an adjustment mechanism includes two threaded openings with threads of different coarseness. A threaded fastener is positioned within the two threaded openings.

In accordance with any embodiment disclosed herein, an adjustment mechanism vertically and/or horizontally repositions at least a segmented optic.

In accordance with any embodiment disclosed herein, a reticle is adapted to block a field of view when viewed through, and/or magnified by, the segmented optic.

In accordance with any embodiment disclosed herein, a reticle includes a contrast component that includes a fiber optic component.

In accordance with any embodiment disclosed herein, a fiber optic component is a light transmitting component configured to transmit light to an edge thereof.

In accordance with any embodiment disclosed herein, a fiber optic component is formed from an end of a round fiber or an edge of a flat fiber.

In accordance with any embodiment disclosed herein, a support structure is adapted to position a segmented optic in an open sight configuration relative to a reticle.

In accordance with any embodiment disclosed herein, a partial optic is configured to project a reticle higher than an actual position of the reticle.

Additional features and advantages of example embodiments will be set forth in the description which follows, and in part will be obvious from the description, or may be learned by the practice of the invention. The features and advantages of the embodiments herein may be realized and obtained by means of the instruments and combinations particularly pointed out in the appended claims. These and other features of the present disclosure will become more fully apparent from the following description and appended claims, or may be learned by the practice of the invention as set forth hereinafter.

BRIEF DESCRIPTION OF THE DRAWINGS

Features and advantages of the embodiments of this disclosure will be apparent from the detailed description that follows, and which taken in conjunction with the accompanying drawings and attachments together illustrate and describe exemplary features of the disclosure herein. It is understood that these drawings merely depict exemplary embodiments and are not, therefore, to be considered limiting of its scope. Additionally, the drawings are generally drawn to scale for some example embodiments; however, it should be understood that the scale may be varied and the illustrated embodiments are not necessarily drawn to scale for all embodiments encompassed herein.

Furthermore, it will be readily appreciated that the components of the illustrative embodiments, as generally described and illustrated in the figures herein, could be arranged and designed in a wide variety of different configurations, and that components within some figures are interchangeable with, or may supplement, features and components illustrated in other figures. Nonetheless, various particular embodiments of this disclosure will be described and explained with additional specificity and detail through the use of the accompanying drawings, in which.

DETAILED DESCRIPTION

Figure 1A:
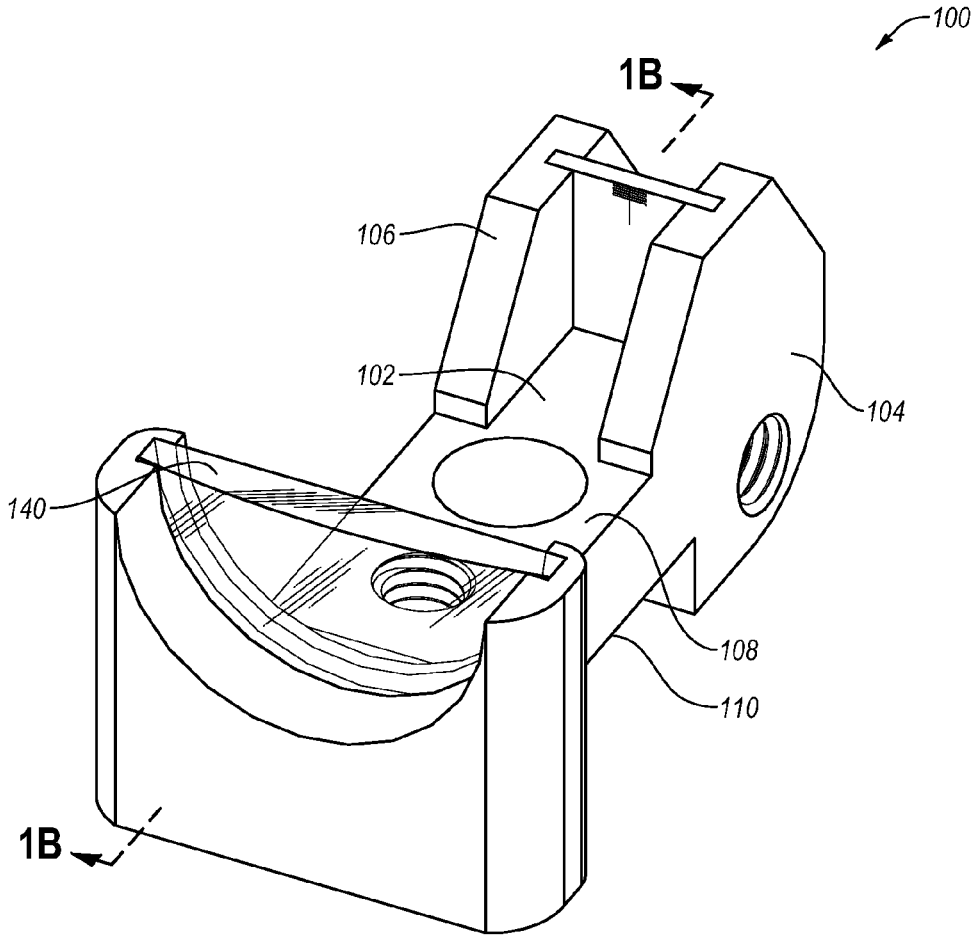
FIG. 1A illustrates a perspective view of a sight according to one embodiment of the present disclosure, and in which the sight includes a reticle and an optical component for magnifying the reticle.

The embodiments described herein generally extend to devices, assemblies, systems, and methods for using a gun sight to target an object. Some devices of the present disclosure are configured to make use of a partial or incomplete optical component, so as to focus on a reticle while maintaining at least a portion of a targeted object within a field of view.

Challenges of traditional sighting devices may include the difficulty in obtaining high degrees of accuracy with lightweight and inexpensive sights over large ranges of distance. Additional challenges for highly accurate sighting devices may include significant expense and/or a lack of portability as the sight or scope increases in weight. Some such sighting devices may also make use of batteries or another depletable power supplies, such that the power supply may become depleted without advance warning to the sight user. By having a sighting device that is lightweight, cost-effective, accurate over large distance ranges, and which does not necessarily rely on external power supplies, these challenges may be overcome, particularly in embodiments of a sighting device that can include selectively interchangeable components to allow even increased accuracy at large ranges. Such results, whether individually or collectively, can be achieved according to one embodiment of the present disclosure, by employing methods, systems, and/or devices as shown in the figures and/or described herein.

Reference will now be made to the drawings to describe various aspects of example embodiments of the disclosure. In the description, example sighting devices may be described with reference to guns, rifles, firearms, or other weapons. It should be appreciated that such objects are described by way of illustration only, and are not limiting of the present invention. Indeed, embodiments of the present disclosure may be used in connection with any number of different devices, including surveying equipment, range finding, or in connection with other equipment or firearms.

It is further to be understood that the drawings included herewith, and which are referenced herein, are diagrammatic and schematic representations of example embodiments, and are not limiting of the present disclosure. Moreover, while various drawings are provided at a scale that is considered functional for some embodiments, the drawings are not necessarily drawn to scale for all contemplated embodiments. No inference should therefore be drawn from the drawings as to the necessity of any scale.

In the exemplary embodiments illustrated in the figures, like structures will be provided with similar reference designations. Specific language will be used herein to describe the exemplary embodiments, nevertheless it will be understood that no limitation of the scope of the disclosure is thereby intended. It is to be understood that the drawings are diagrammatic and schematic representations of various embodiments of this disclosure, and are not to be construed as limiting the scope of the disclosure, unless such shape, form, scale, function, or other feature is expressly described herein as essential. Alterations and further modifications of the inventive features illustrated herein, and additional applications of the principles illustrated herein, which would occur to one skilled in the relevant art and having possession of this disclosure, are to be considered within the scope of this disclosure. Unless a feature is described as requiring another feature in combination therewith, any feature herein may be combined with another feature of a same or different embodiment disclosed herein. Furthermore, various well-known aspects of optics, sighting, manufacturing processes, and the like are not described herein in particular detail in order to avoid obscuring aspects of the example embodiments.

Turning now to the drawings, FIG. 1A depicts an illustrative embodiment of a sighting device 100 for sighting objects within a field of view. The sighting device 100 may, for instance, be used in connection with a handgun, rifle, or other type of firearm or other device to sight an object and/or to facilitate accurate projection of a bullet, slug, arrow, or other projectile at the target. In the illustrated embodiment, the sighting device 100 may include a body 102, an optical component 140, and a reticle 150. The body 102 may, in some instances, be configured to act as a retention structure. For instance, the body 102 may be configured to retain the reticle 150 and/or the optical component 140 at particular locations relative to each other or relative to the body 102.

To facilitate discussion herein, the body 102 may be referred to as having a distal end and a proximal end. In such context, and with regard to FIG. 1A, the body 102 may generally have the optical component 140 positioned at, near, or toward the proximal end of the body 102, whereas the reticle 150 may be positioned at, near, or toward the distal end of the body 102. It should be appreciated in view of the disclosure herein that the reference to ends of the body as proximal or distal is purely arbitrary so as to facilitate a description of the exemplary embodiments herein, and that in other embodiments, the proximal end could be referred to as the distal end, and vice versa.

Figure 1B:
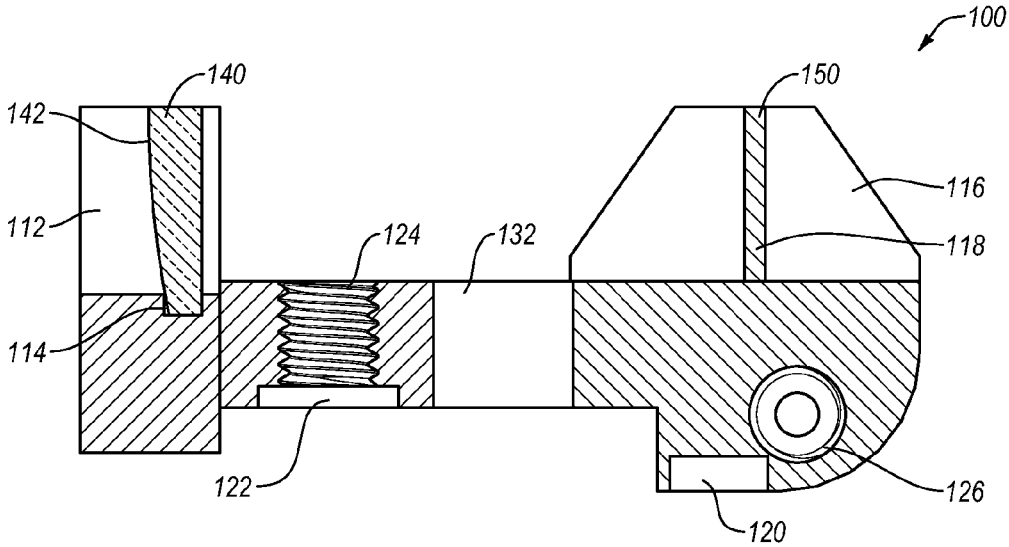
FIG. 1B illustrates a cross-sectional side view of the sight of FIG. 1A.

The body 102 may have any suitable shape, structure, dimension, or other feature, or any combination of the foregoing. In the embodiment illustrated in FIGS. 1A and 1B, for instance, the body 102 has a generally elongated form. At the proximal end of the elongated body 102 is an optical support 112, while the distal end of the elongated body 102 of the present embodiment includes a reticle mount 116. In the illustrated embodiment, the elongated body 102 includes external side surfaces 104, 106, and upper and lower body surfaces 108, 110. In some embodiments, such as that shown in FIGS. 1A and 1B, the reticle mount 116 may have side surfaces aligned, and optionally integrally formed, with the external side surfaces 104, 106 of the body 102. A distance between the upper and lower body surfaces 110, 112 may define a thickness of the body 102. Such thickness may be generally constant, although in other embodiments the thickness may vary. For instance, as best illustrated in FIG. 1B, a central portion of the body 102 may have a generally uniform thickness, while the thickness may increase, or otherwise change near the proximal or distal ends of the body 102.

The width of the body 102 may also be uniform or may change. As best illustrated in FIG. 1A, for instance, the central portion of the body 102 and the reticle mount 116 have a generally uniform width that may be defined generally by the distance between the external side surfaces 104, 106. Optionally, the optical support 112 may have a differing width. By way of illustration, in the illustrated embodiment, the optical support 112 has a width that exceeds the distance between the external side surfaces 104, 106 of the body 102, although in other embodiments, the optical support 112 may have a width that is less than or equal to the width of the body 102 and/or the reticle mount 116. In some embodiments, the increased width of the optical support 112 may correspond to a size of the optical component 140.

The optical component 140 and the reticle 150 are generally illustrative of any of a number of different types of optics and sighting mechanisms that may be employed in a sighting device according to the present invention. According to one embodiment, for instance, the optical component 140 may include a lens or a component thereof. In FIGS. 1A and 1B, for instance, the optical component 140 is a lens having at least one convex surface 142. In particular, in the illustrated embodiment, the optical component 140 is generally illustrated as a plano-convex lens. In other embodiments, however, other types of optics may be used. For instance, the optical component 140 may alternatively include a double-convex lens, a concavo-convex lens, or any other suitable lens or optical structure.

The optical component 140 may in some embodiments include a full lens, and in other embodiments may include a lens segment or a set of lens segments. According to the embodiment in FIGS. 1A and 1B, the optical component 140 includes a partial or incomplete lens. More particularly, the optical component 140 may include a lens segment that is approximately half of a full, circular lens. For instance, a full lens may be cut along a center thereof and then placed in the optical support 112. A half-lens is merely one example of an optical component. In alternative embodiments, an optical component according to an embodiment of the present invention may include a quarter-lens, a full-lens, a three-quarter lens, or any other portion of a lens or optical component. Indeed, it is also not necessary that the optical component be formed from, or separated as a part of, a circular lens. For instance, the optical component may have a triangular, square, diamond-like, trapezoidal, cross-shaped, or other shape as desired.

Whatever the form of the optical component 140, the optical support 112 may be used to facilitate securement of the optical component 140 to the body 102. As shown in FIGS. 1A and 1B, for instance, the optical support 112 may include a groove 114 formed therein. The groove 114 is, in this embodiment, sized and shaped so as to correspond generally to the size and shape of the optical component 140. For instance, the groove 114 may have a generally rectangular cross-sectional shape, and follow along a semi-circular path in the optical support 112. The optical component 140 may then be placed within the groove 114 and secured therein. In the illustrated embodiment, the groove 114 is sized such that an upper surface of the optical component 140 is generally flush with an upper surface of the optical support 112, although this is merely exemplary. In other embodiments, an upper surface of the optical support 112 may be vertically higher or lower relative to the optical component 140. When positioned in the groove 114, the optical component 140 may be permanently or selectively secured therein using any suitable mechanism. For instance, in one embodiment, the optical component 140 has a friction or interference fit with the groove 114. In another embodiment, the optical component 140 is secured within the groove 114 using an adhesive. In still other embodiments, mechanical components (e.g., dovetail grooves) or other structures are used to securely maintain the optical component 140 in the groove 114 or otherwise within the optical support 112.

The reticle 150 may also take any suitable shape or form, and may be selectively or permanently secured to the sighting device 100 in any suitable manner. For instance, according to one embodiment, the reticle 150 may have a generally rectangular shape and be positioned within a rectangular groove 118 formed within or otherwise defined by the reticle mount 116 of the body 102. As the shape and size of the groove 118 may generally correspond to the shape and size of the reticle 150, the reticle 150 may be positioned in the groove 118, slid into place (e.g., below, above, or aligned with the top surface of the reticle mount 116), and then secured therein. As with the optical component 140, the reticle 150 may be secured therein by any suitable mechanism, including at least an interference fit, adhesive, mechanical fastener, or other device, or a combination thereof. In some embodiments, the optical component 140 and/or the reticle 150 are selectively removable. For instance, the reticle 150 may be selectively removable so as to allow replacement to accommodate differences in types of devices or firearms, different ranges of use, different ballistics, or the like. The optical component 140 may also be selectively removable. For instance, in the event the optical component 140 is scratched, broken, or otherwise damaged, the optical component 140 may be removed and replaced. In other embodiments, a body 102 may include multiple reticle mounts 116 and/or grooves 118. Each reticle mount 116 or groove 118 may accommodate a different type or configuration of reticle 150, or be positioned to allow for accuracy at different ranges. Depending on the distance of the groove 118 from the optical support 112, the optical component 140 may also be replaceable to allow for effective use of each reticle 150.

Figure 1C:
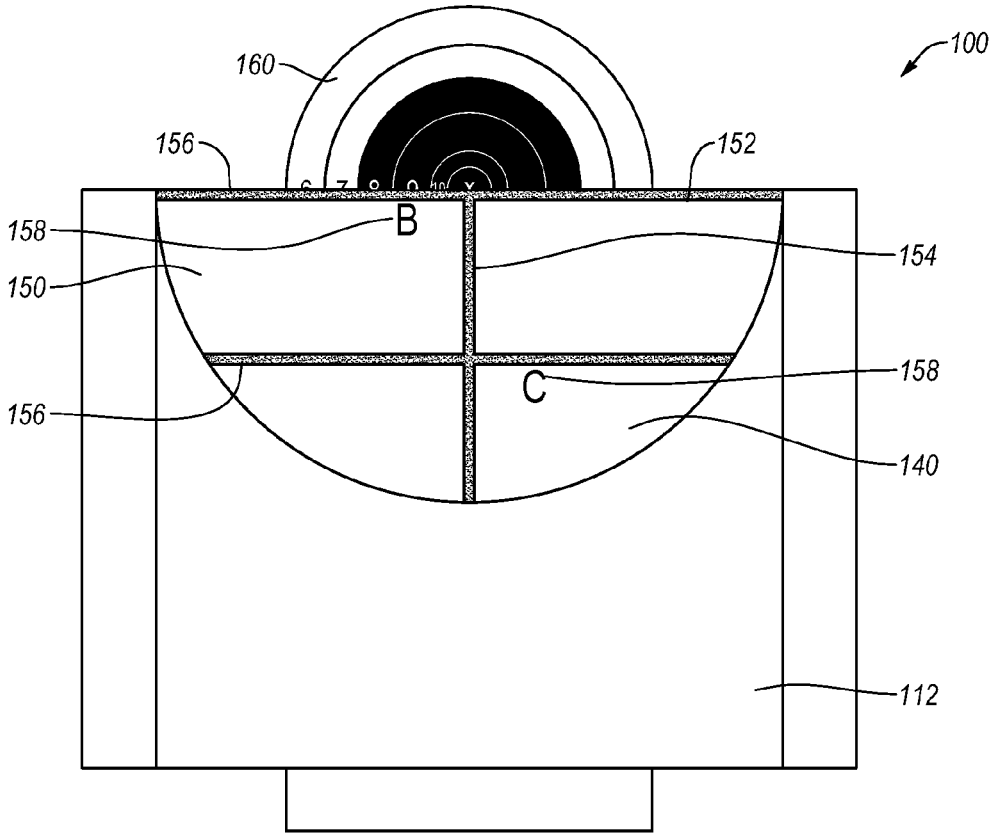
FIG. 1C illustrates a frontal view of the sight of FIGS. 1A and 1B, with the optical component magnifying the reticle and indicia on the reticle.

According to one embodiment of the present disclosure, the sighting device 100 is configured to operate by magnifying all or a portion of the reticle 150, and in a manner that allows sighting of the sighting device 100 on a desired target. According to one embodiment, for instance, the optical component 140 may be a lens that is configured to magnify all or a portion of the reticle 150. For instance, as best shown in FIGS. 1A and 1C, the reticle 140 may include indicia 152 thereon. According to one embodiment, the indicia 152 may include multiple identifiers or markers used to accurately sight a target anywhere within a wide range of different distances.

With particular reference to FIG. 1C, a frontal view of an exemplary sighting device 100 is illustrated and shows an aspect of the sighting device 100 when in use. In the illustrated embodiment, the optical component 140 has focused on the reticle 150, and magnified the reticle 150, including the indicia 152 that is positioned thereon. In the illustrated embodiment, the indicia 152 includes a vertical bar 154, multiple horizontal bars 156, and identification members 158.

Each of the vertical bar 154, horizontal bars 156, and identification members 158 may be used in connection with the optical component 140 to sight on an object. In particular, the vertical bar 154 may be magnified by the optical component 140 and positioned generally vertical and centered within the optical component 140, as shown in FIG. 1C. In such a position, and by raising or lowering the sighting device 100 relative to the user's point of view, the horizontal bars 156 may be made to raise or drop within the optical component 140. As shown in FIG. 1C, two horizontal bars 156 may be visible at a single time, although more or fewer bars may be viewable at once. For instance, in one embodiment, a single horizontal bar 156 may be viewed at any particular time.

As the sighting device 100 is raised or lowered and the horizontal bars 156 corresponding move through the magnified view of the optical component 140, the T-intersection between a horizontal bar 156 and the vertical bar 154 may be aligned on a target. According to one exemplary embodiment, for instance, the optical component 140 may provide focus solely on the reticle 150, such that the reticle 150 and/or the lens 140 obstruct at least a portion of the user's field of view. In such an embodiment, the target may be aligned with a top surface of the optical component 140. The reticle 150 may then be aligned relative to the optical component 140, such that a desired horizontal bar 156 is also approximately aligned along a top surface of the optical component 140. The horizontal bar 156 and the vertical bar 154 may form a T-shape that can then be aligned against the target.

In some embodiments, the indicia 152 of the reticle may facilitate accuracy of the sighting device 100 over a range of different distances. As shown in FIG. 1C, for instance, there may be multiple horizontal bars 156. Each horizontal bar 156 may correspond to a different distance. For instance, the indicia 152 may include four horizontal bars 156. One horizontal bar 156 may correspond to a distance of one-hundred yards, while a second corresponds to a distance of two-hundred yards, and so on. To further facilitate use of the sighting device 100, according to one embodiment, the reticle 150 includes identification members 158. The identification members 158 may take any number of different forms. In one embodiment, for instance, the identification members 158 may be generic markers to differentiate the horizontal bars 156. For instance, letters (e.g., A, B, C, D, etc) or numbers (e.g., 1, 2, 3, 4, etc.) may identify which bar 156 is being magnified through the optical component 140.

Each identification member 158 may correspond to a different distance for the particular device with which the sighting device 100 is used. Accordingly, the identification members 158 may act as distance identifiers. In other embodiments, the identification members 158 may more directly identify distances. For instance, one horizontal bar 156 may identify a distance of 100 yards, a second may show a distance of 200 yards, and so on. Regardless of the specific type of identification member 158 or distance identifier, if any, a user can determine an approximate distance of a target, select an appropriate horizontal bar 156, and align an intersection of the selected horizontal bar 156 and vertical bar 154 with the target. If the target is at a distance between those specified for the horizontal bars 156, the user can approximate the distance by aligning the vertical bar 154 on the target, and the horizontal bar 156 slightly below the top of the optical component 140.

The accuracy of the reticle 150 of the illustrated embodiment may be determined at least in part by the number of horizontal bars 156 machined, printed, or otherwise provided on the reticle 150, as well as the distance of separation between the horizontal bars 156. According to one embodiment, a firearm and ballistics combination may be known to have a four and one-half inch drop over one hundred yards. The drop distance may be correlated to the distance between the horizontal bars 156. For instance, a horizontal bar separation of approximately 0.001" may account for the four and one-half inch drop. As such, at a second horizontal bar (e.g., bar "B"), a bullet or other projectile may be four and one-half inches higher at two hundred yards than a similar bullet aligned on a first horizontal bar (e.g., bar "A").

As will be appreciated, the number of horizontal bars 156 and the separation between the bars 156 may be varied based on any number of factors. For instance, a high-powered firearm (e.g., a .30/30, .30/06, .270 Winchester, and/or .308) may have a smaller drop distance over one-hundred yards than a relatively lower powered firearm (e.g., .22 rimfire, .357 magnum handgun, and/or .44 magnum handgun). Accordingly, a reticle 150 for the low-powered firearm may have a larger separation between horizontal bars 156, or horizontal bars 156 may correspond to different distance increments (e.g., feet instead of yards).

The number of horizontal bars 156 may also vary. For instance, if the horizontal bars 156 may be closely grouped together, more horizontal bars 156 may be included on the reticle 150. Depending on the height of the optical component 140 and the reticle 150, the reticle 150 may, at some point, obstruct the target and field of view for lower horizontal bars 156. Accordingly, in some embodiments the maximum range supported by the reticle 150 may be limited.

The reticle 150 may also be configured in any number of different manners to allow for rapid and efficient sighting for a corresponding firearm or other device. In some embodiments, the reticle 150 may be formed of a clear or substantially transparent plastic, glass, or other material. In other embodiments, the light reflected through the reticle 150 may be at least partially diffused. For instance, the reticle illustrated in FIGS. 1A-1C may have color or another component added for contrast. One feature of adding contrast is that it may facilitate rapid alignment of the sighting device 100. For instance, as a user looks through the optical component 140, a color or other contrast of the reticle 150 may allow the user selectively place the optical component 140 and reticle 150 substantially in-line, so as to quickly find the horizontal bars 156 and/or vertical bar 154. In contrast, in embodiments in which the reticle 150 is substantially transparent, no color or contrast may be immediately viewable. In some such embodiments, the user may have increased difficulty determining whether the reticle 150 and optical component 140 are close to being properly in-line.

In embodiments in which contrast is added to the reticle 150, such contrast may be added in any number of suitable manners. According to one embodiment, for instance, the reticle 150 may be formed from a colored or pigmented piece of glass, plastic, or other material. In another embodiment, a colored or pigmented film may be applied to the reticle 150, or paint or a similar coloring agent may be applied to the reticle 150. In still other embodiments, a fiber optic material may be used. For instance, a fiber optic material configured to transmit light may be used. The fiber optic material may draw in available light and direct the light in a manner that provides lighting even in dimly lit conditions. By way of example, a light transmitting fiber optic component similar to those used in archery pins or cross-hairs may be used to form all or a portion of the reticle 150. As light contacts the reticle 150, the light may be transmitted to an edge of the fiber. When the reticle 150 is viewed through the optical component 140, the lit edge of the fiber may fill all or substantially all of the optical component 140, as if a light is shining on the optic. The fiber material could, for example, be formed from a round piece and viewed from an end. Alternatively, the fiber material could be formed from a plat piece and viewed along an edge. Accordingly, in some embodiments, the reticle directs the available light to provide lighting and produce or simulate a color or contrast that is readily perceivable through the optical component 140, even in the absence of large quantities of light.

As will be appreciated in view of the disclosure herein, the optical component 140 that may be used in accordance with the present invention may be varied in a number of suitable manners, according to the particular aspects of the desired sighting device. For instance, according to one embodiment, the optical component 140 is a lens of relatively high positive power. For instance, an exemplary lens may have a power of between about 30× to about 80×, although this is merely exemplary, and the power may be more than 80× or less than 30×. The lens may further be configured for use at any number of different distances. For instance, the lens or other optical component 140 may be used with relatively close proximity to the user's eye. By way of illustration, the optical component 140 may be configured to be used at a distance that provides sufficient eye relief relative to any recoil of the firearm. In another embodiment, the optical component 140 may be configured to be used at a significant distance from the user's eye. For instance, where the optical component 140 is placed on a handgun, the sighting device 100 may provide magnification of the reticle 150 at a distance between about a half arm length to a full arm length. According to one embodiment, the lens may have characteristics such as those set forth in Table 1, although such lens is merely exemplary. Other lenses having different sizes (e.g., diameter, focal lengths, radii, thickness), quality, materials, or the like are also usable. The properties of a lens as set forth in Table 1 thus correspond to only one of any number of different lens or optical components contemplated within the scope of the disclosure and claims.

TABLE 1

| | |
|---|---|
| Diameter | 15.00 mm |
| Clear Aperture | 14.00 mm |
| Effective Focal Length | 22.50 mm |
| Back Focal Length | 20.50 mm |
| Radius | 15.12 mm |

TABLE 1-continued

| | |
|---|---|
| Edge Thickness | 1.36 mm |
| Center Thickness | 3.35 mm |
| Centering | 3-5 arcminutes |
| Surface Quality | 40-20 |
| Bevel | Max = 0.25 mm × 45° |
| Substrate | N-SF5 |
| Design Wavelength | 587.6 nm |
| Coating | VIS-NIR |
| RoHS | Exempt |

As also shown in FIGS. 1A-1C, a sighting device 100 according to the present disclosure may effectively operate as an open sight. In particular, in the illustrated embodiments, the sighting device 100 may be used by aligning the upper surface of the exemplary optical component 140 with a target and indicia 152 on the reticle 150. The optical component 140 and/or reticle 150 do not need to be contained within a tube or chamber, or otherwise enclosed, and can thus provide the benefits of open sights, such as low cost, simplicity of use, and light weight. Moreover, the optical and reticle components of the disclosed embodiments can improve accuracy by not only providing a similar size, weight, cost, or other features, or combinations thereof, of an open sight, but while also providing accuracy comparable to those of crosshairs in a scope device. Indeed, one aspect of some embodiments of the present disclosure is that the sight remains open, thereby allowing the benefits of an open sight (e.g., weight, size, ability to holster a pistol, etc.). While providing the benefits of an open sight, sights described herein nevertheless also provide nearly the same accuracy as a scope. Accordingly, potentially the best features of open sights and a scope can be combined into a single sighting device.

In some optional aspects, the sighting device 100 may also include one or more adjustment mechanisms by which the sighting device 100 may be adjusted or manipulated so as to improve accuracy. For instance, the sighting device 100 may be adjusted for use with one type of firearm or projectile, and then re-calibrated or adjusted to accurately sight a second type of firearm or projectile.

Exemplary adjustment mechanisms are described throughout the disclosure herein, and particularly with reference to FIGS. 1B-3B. In such embodiments, a particular example of an adjustment mechanism is described and illustrated for lateral and vertical adjustments, although in other embodiments, only lateral or vertical adjustments may be available, or other types of adjustment mechanisms may be employed.

Figure 1D:
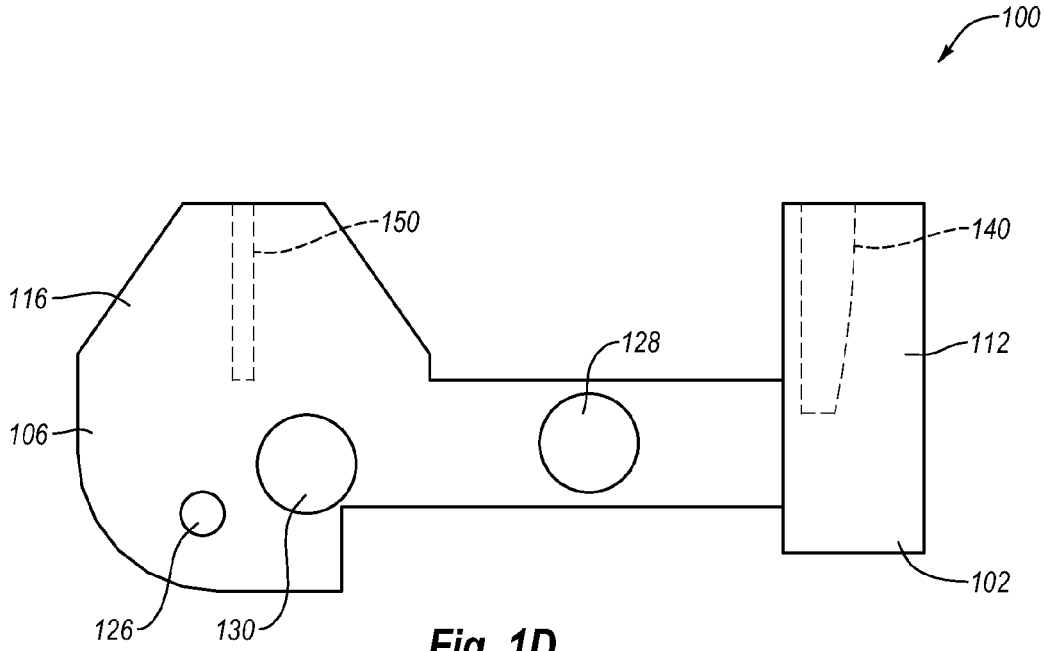
FIG. 1D illustrates a side view of the sight of FIGS. 1A and 1B.

With particular reference to FIGS. 1B and 1D, the exemplary sighting device 100 of FIG. 1A is illustrated and described with regards to a particular example of an adjustment mechanism. As shown in this particular embodiment, the body 102 may include any number of different structures. For instance, as described above, the body 102 may include or be coupled to an optical support 112 that supports or couples to an optical component 140, and/or a reticle mount 116 that supports or couples to a reticle 140. Still additional structures may be included, including one or more vertical adjustment seats 120, 122 (FIG. 1B), one or more lateral adjustments seats 128, 130 (FIG. 1D), one or more vertical adjustment channels 124 (FIG. 1B), and/or one or more lateral adjustment channels 126 (FIG. 1B).

Figure 3A:
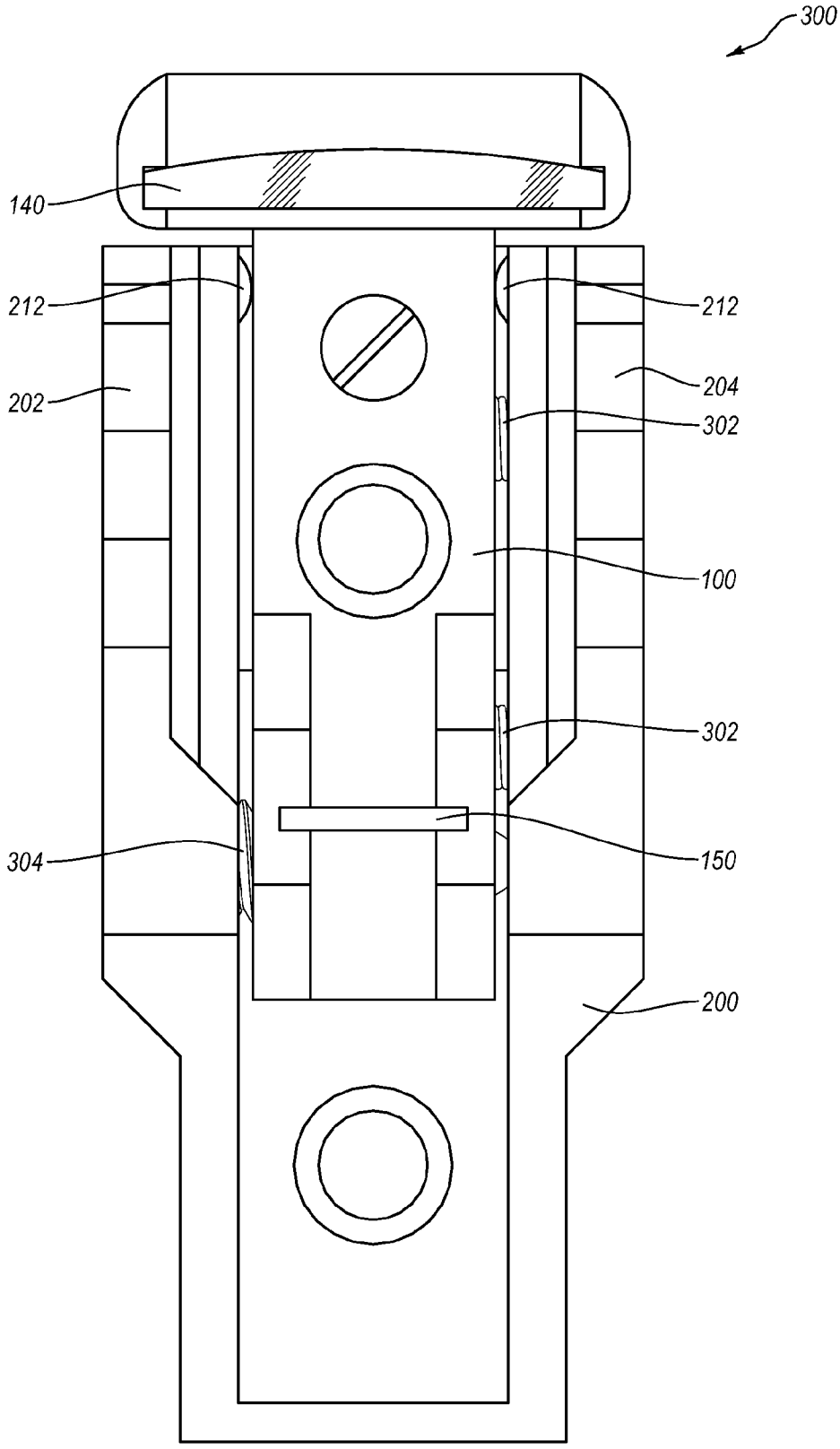
FIG. 3A illustrates an overhead view of a sighting assembly that includes the sight of FIGS. 1A-1D and the sight mount of FIGS. 2A and 2B.
Figure 3B:
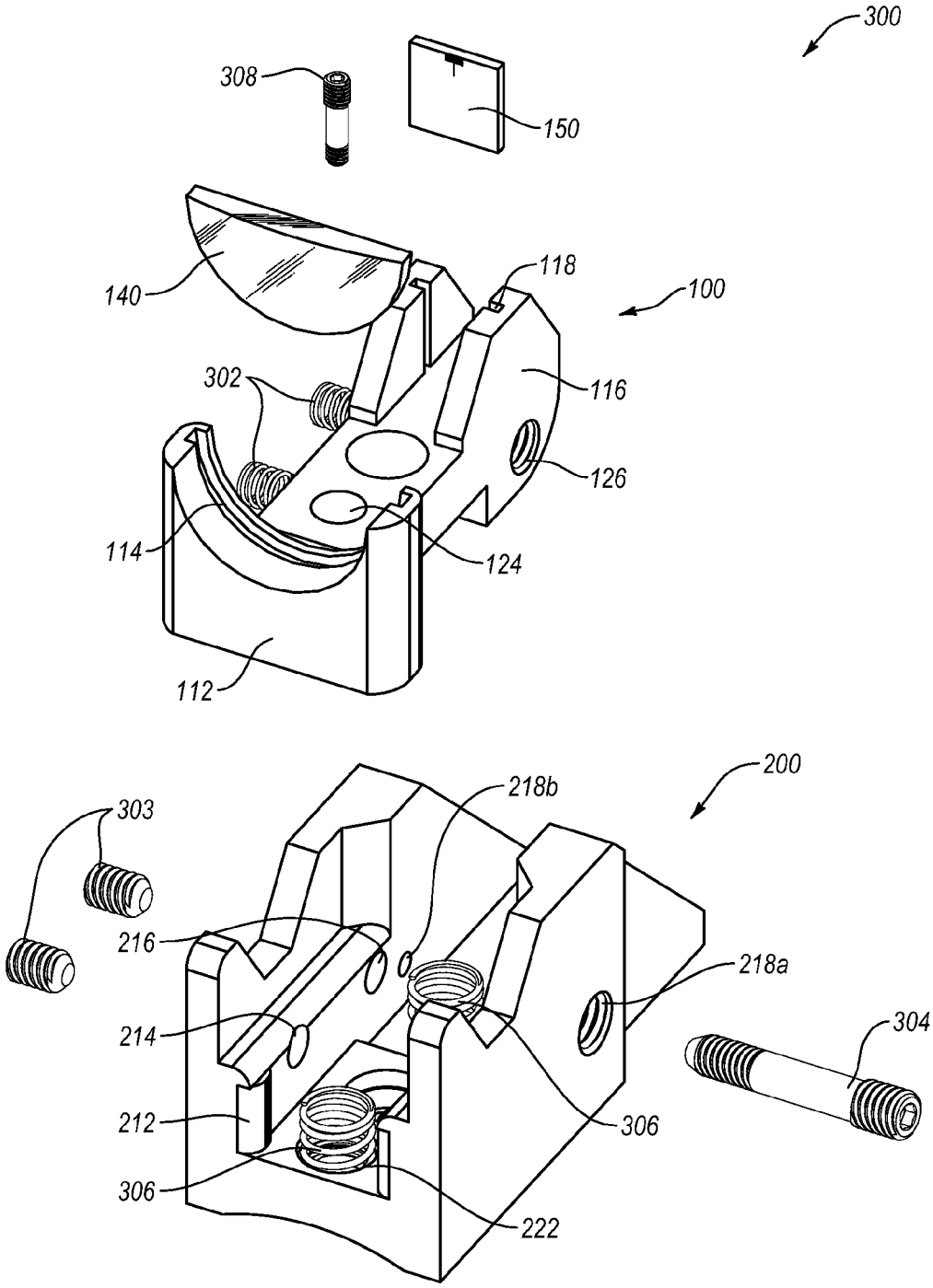
FIG. 3B illustrates an exploded view of the sighting assembly of FIG. 3A.

As described in greater detail hereafter, and particularly with regard to FIGS. 3A and 3B, adjustment seats 120, 122, 128, 130 and adjustment channels 124, 126 may be used in combination with other components to allow for the adjustment of the sighting device 100. In some embodiments, the adjustment may be made on a very small level, such that micro-adjustments may be made. For instance, adjustments may be made well below tolerances of even 0.001". For instance, an adjustment mechanism as described herein may make adjustments of almost infinitely small variation.

As shown in FIG. 1B, vertical adjustment seats 120, 122 are provided. In the illustrated embodiment, a first vertical adjustment seat 120 is provided near a distal end of the body 102 of the sighting device 100. In this embodiment, the vertical adjustment seat 120 is formed in the lower surface of the reticle mount 116 of the body 102. More particularly, in this embodiment, the vertical adjustment seat 120 comprises a channel that extends vertically through a partial thickness or height of the body 102. The second vertical adjustment seat 122 is similarly formed, and is located in a central portion of the body 102. More particularly, in this embodiment, the second vertical adjustment seat 122 is formed generally proximate to the optical support 112, and is also formed in a lower surface 110 of the body 102. The second vertical adjustment seat 122 may also comprise a channel that extends partially through a thickness or height of the body 102.

Second vertical adjustment seat 102 is also optionally in communication with an adjustment channel 124. For instance, in FIG. 1B, the adjustment channel 124 is illustrated as being generally coaxial with the second vertical adjustment seat 122. The adjustment channel 124 and the second vertical adjustment seat 122 may form an opening passing through all or substantially all of a thickness of the body 102.

Lateral adjustments may also be made by using one or more features on or acting in concert with the sighting device 100. In FIG. 1D, for instance, two lateral adjustment seats 128, 130 are formed at least partially in the side surface 106 of the body 102. For instance, in one embodiment, the lateral adjustment seats 128, 130 define channels that extend partially through the width of the body 102. For instance, in one embodiment, the lateral adjustment seats 128, 130 extend from side surface 106 but do not form through-holes extending fully to side surface 104. As with the vertical adjustment mechanism, the lateral adjustment mechanism may also include a lateral adjustment channel 126. As best shown in FIG. 1D, the lateral adjustment channel 126 may be offset from each of the lateral adjustment seats 128, 130, although this is merely exemplary. In other embodiments, the lateral adjustment channel 126 may be coaxial with, or otherwise intersect, the lateral adjustment seats 128, 130. Similarly, vertical adjustment channel 124 may alternatively be offset or otherwise out of alignment with vertical adjustment seats 120, 122. In still other embodiments, the lateral adjustment channel 126 may have a substantially constant width along a length thereof. In other embodiments, such as that illustrated in FIG. 1B, the diameter or width of the lateral adjustment channel 126 may change along its length by, for example, tapering from a larger width to a smaller width.

The specific operation of the adjustment mechanisms previously described is presented in greater detail hereafter. For instance, the lateral and/or vertical adjustment seats 120, 122, 128, 130 may have one or more biasing members seated thereon. One or more fasteners may also pass through the lateral and/or vertical adjustment channels 124, 126, and may be selectively adjustable so as to vary the position of the sighting device 100 relative to a mounting structure and/or attached device, and can also selectively vary the force applied to a biasing member.

Figure 2A:
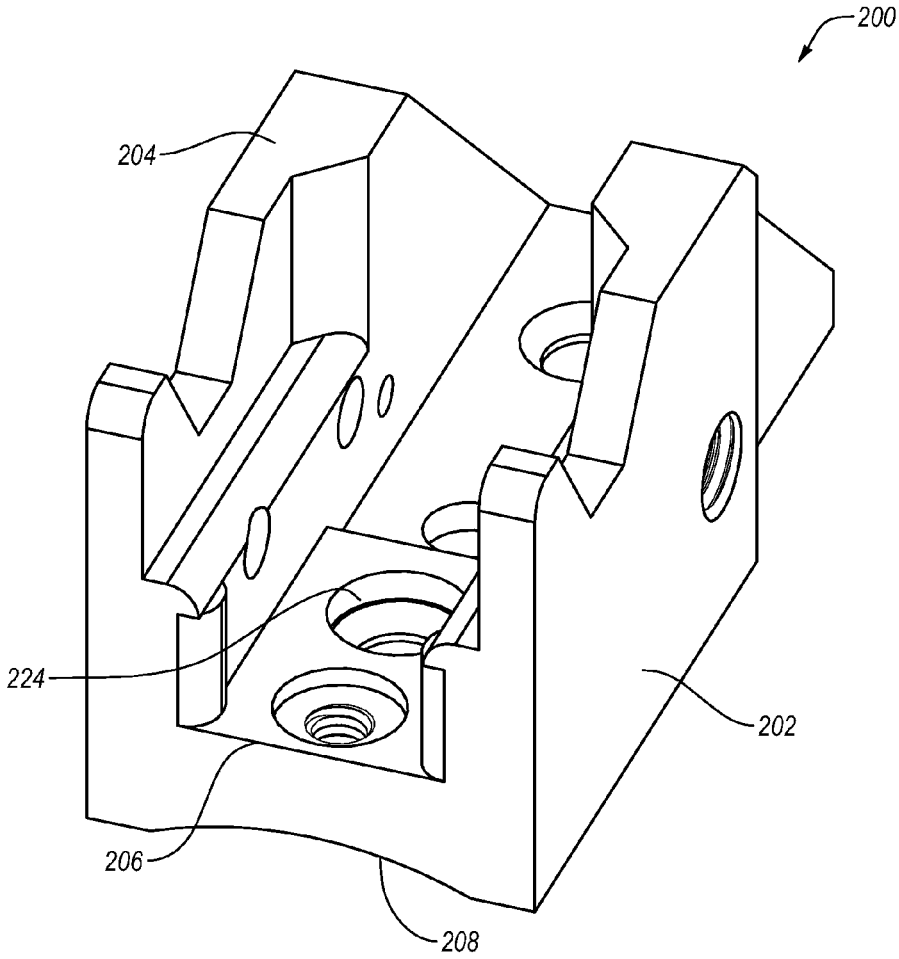
FIG. 2A illustrates a perspective view of an exemplary sight mount according to one embodiment of the present disclosure, and which sight mount may be used in some aspects to mount the sight of FIGS. 1A-1D to a firearm or other suitable device.
Figure 2B:
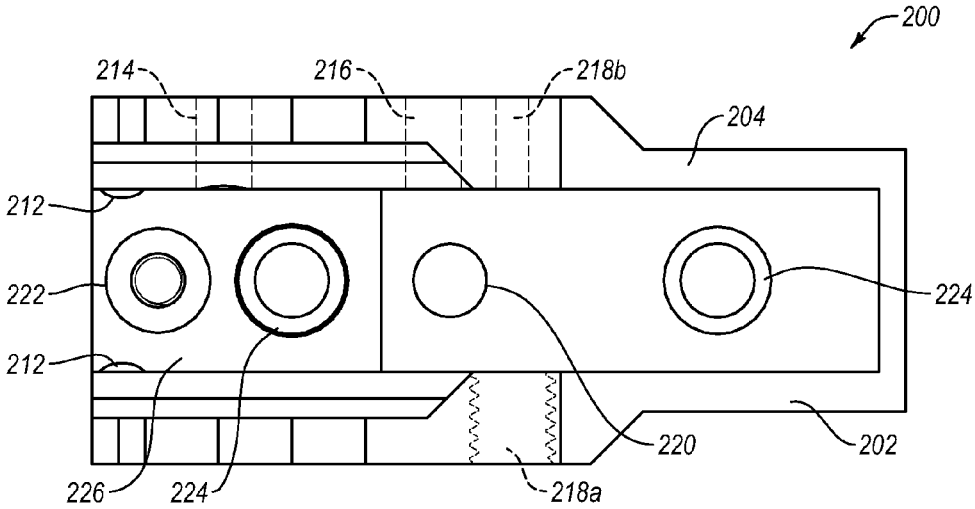
FIG. 2B illustrates an overhead view of the sight mount of FIG. 2A.

Now turning to FIGS. 2A and 2B, an exemplary embodiment of a sight mount 200 is illustrated and described according to some aspects of the present disclosure. It should be appreciated that sight mount 200 is merely illustrative of an additional component that may be used in combination with the sighting device 100 of FIGS. 1A-1D. In some embodiments, the sight mount 200 may facilitate mounting of the sighting device 100 to a firearm or other device, and/or may facilitate implementation of the one or more adjustment mechanisms.

For example, FIG. 2A illustrates the exemplary sight mount 200 according to one embodiment, in which the sight mount 200 includes a base having upper and lower base surfaces 206, 208 and corresponding sides 202, 204 projecting upward from the upper base surface 206. In some embodiments, the distance between the sides 206, 208 may define a sighting channel. The sighting channel may, for instance, be configured to receive at least a portion of a sighting device (e.g., sighting device 100 of FIG. 1A). By way of illustration, in one embodiment, the sighting channel has a width that is about the same as, or slightly larger than, the width of the central portion of the body 102 of the sighting device (FIG. 1A).

The body 102 may also be positioned in a manner that aligns the body 102 relative to the sight mount 200. For instance, the body 102 may include a securement channel 132 passing through a thickness or height thereof. The securement channel 132 of the body 102 may be aligned with a fastener opening 224 in the upper surface 206 of the base of the sight mount 200. By aligning the securement channel 132 (FIG. 1B) with the fastener opening 224 (FIG. 2A), a fastener such as a rivet, screw, bolt, or other fastener, or any combination of the foregoing, may secure the sighting device 100 to the sight mount 200. Additionally, or alternatively, the fastener may pass through the fastener opening 224 and connect to a device with which the sighting device 100 is to be used. For instance, in FIG. 2A, the lower base surface 208 has a curved configuration. Such a configuration may, for instance, be configured to match a rounded profile of a barrel of a firearm, a rounded surface of a theodolite, or any other surface of a suitable device. A fastener passing through fastener opening 224 may thus cause the lower base surface 208 to mate with and engage a corresponding surface of a corresponding device. In some embodiments, the sight mount 200 may include multiple fastener openings 224 to allow the sight mount 200 to be selectively secured to a corresponding device.

Turning now to FIG. 2B, components of an exemplary sight mount 200 are described in additional detail, particularly with regard to sight adjustment mechanisms. As discussed hereafter primarily with reference to FIGS. 3A and 3B, some exemplary components may cooperate with components of the sighting device 100 (FIGS. 1A-1D) to allow adjustment of the sighting device 100.

In FIG. 2B, the sight mount 200 may include a plurality of openings or other structures configured to facilitate adjustment of a sighting device mounted within or relative to the sight mount 200. For instance, in one aspect, an exemplary sight mount 200 may include a set of one or more lateral adjustment openings 214, 216. In FIG. 2B, two lateral adjustment openings 214, 216 are illustrated in phantom lines, and are depicted as passing through a full thickness of the second side 204 of the sight mount 200. It will be appreciated that such openings are merely optional, and one or more of the lateral adjustment openings 214, 216 may be excluded, or additional lateral adjustment openings may be added. In still other embodiments, the relative positions of the lateral adjustment openings 214, 216 may be moved from the generally proximal and central locations, respectively, to alternative locations within the sight mount 200. In still other embodiments, lateral adjustment openings 214, 216 may extend only through a portion of the thickness of the second side 204.

Cooperating in this embodiment with the lateral adjustment apertures 214, 216 is a lateral adjustment aperture 218*a*, 218*b*. In FIG. 2B, the lateral adjustment aperture 218*a*, 218*b* is shown as passing through a full width of the sight mount 200. In particular, the illustrated lateral adjustment aperture 218*a*, 218*b* includes a first aperture 218*a* extending through the first side 204, and a second aperture 218*b* extending through the second side 206 of the sight mount 200. In the illustrated embodiment, first and second apertures 218*a*, 218*b* have differing diameters. In particular, first aperture 218*a* has a larger diameter and steps down to a smaller diameter of second aperture 218*b*. In some embodiments, second aperture 218*b* may act as a pilot hole while first aperture 218*a* acts to cooperate with an adjustment mechanism to translate a movement of a fastener or other component into an adjustment of a sighting device operating in conjunction with the sight mount 200.

Also illustrated in FIG. 2B are a plurality of optional vertical adjustment seats 220, 222. In some embodiments, the vertical adjustment seats 220, 222 may be channels formed in the upper base surface 206 of the sight mount 200, and extend fully or partially through a thickness of the base. For example, the vertical adjustment seats 220, 222 may extend in some embodiments partially through a thickness of the base of the sight mount 200, and provide a mechanism by which one or more biasing mechanisms may bias a sighting device relative to the sight mount 200.

In FIG. 2B, the second vertical adjustment seat 222 may include an additional opening or aperture. For instance, the second vertical adjustment seat 222 may also be configured as a fastener. In one exemplary embodiment, the second vertical adjustment seat 222 has internal threads to define a female threaded connector. The second vertical adjustment seat 222 may made with a male threaded connector, such as a screw.

Turning now to FIGS. 3A and 3B, an exemplary optical sighting assembly 300 will be described in additional detail. In referring to the optical sighting assembly 300, reference will be made to components or aspects of the sighting device 100 of FIGS. 1A-1D and of the sight mount 200 of FIGS. 2A and 2B to describe one exemplary embodiment in which the sighting device 100 can be used with the sight mount 200. In FIG. 3A, an optical sighting assembly 300 has been produced using, at least in part, the sight mount 200 of FIGS. 2A and 2B and the sighting device 100 of FIGS. 1A-1D. In FIG. 3B, an exploded view is provided to illustrate an exemplary manner of assembly a sight mount 200 with a sighting device 100.

According to one example embodiment, a sighting device 100 is included within the sighting assembly 300 and attached to the sight mount 200. In the illustrated embodiment, for instance, the sighting device 100 may be positioned between sides 204, 206 of the sight mount 200, and within an exemplary sighting channel. According to one embodiment, the sighting device 100 may have components that align with corresponding components of the sight mount 200. For instance, a fastener opening 224 (FIG. 2A) of the sight mount 200 may align with a corresponding securement channel 132 (FIG. 1B) of the sighting device. A fastener (not shown) may then pass within or through the securement channel 132 and/or fastener opening 224 to couple the sighting device 100 to the sight mount 200.

Additionally, or alternatively, other components may also be aligned or may cooperate to facilitate assembling sighting assembly 300 from the sighting device 100 and the sight mount 200. In some embodiments, a coupling between the sighting device 100 and the sight mount 200 may also act as a one or more adjustment mechanisms. For instance, in FIGS.

3A and 3B, a lateral adjustment mechanism and a vertical adjustment mechanism may couple the sighting device 100 to the sight mount 200.

More particularly, in the illustrated embodiment, a vertical adjustment screw 308 and/or a lateral adjustment screw 304 may be provided and sized to cooperate with one or both of the sighting device 100 and the sight mount 200. For instance, the vertical adjustment screw 308 may be sized to fit within the vertical adjustment channel 124 of the sighting device 100, as well as within the vertical adjustment seat 222 of the sight mount 200. In one embodiment, the vertical adjustment channel 124 of the sighting device 100 and the vertical adjustment seat 222 of the sight mount may have internal threads, thereby defining a female threaded connector configured to engage the threads of the vertical adjustment screw 308. In some embodiments, the vertical adjustment channel 124 and the vertical adjustment seat 222 have internal threads of different coarseness. In such an embodiment, the vertical adjustment screw 308 may be a complex screw having threads of differing pitch or coarseness, although a single thread coarseness may be used. While the foregoing refers to the vertical adjustment screw 308 as a "screw," it should be appreciated that such reference is merely for convenience. The vertical adjustment screw 308 generally represents any threaded connector, including screws and other male threaded connectors, as well as any clips, pins, clamps, ratchets, and any number of other different connectors and/or adjustment mechanisms.

In a manner similar to that described above, a lateral adjustment screw 304 optionally cooperates with both the sighting device 100 and the sight mount 200 within the optical sighting assembly 300. In the illustrated embodiment, for instance, the lateral adjustment screw 304 may extend at least partially through the lateral adjustment aperture 218*a* of the sight mount 200 as well as through the lateral adjustment channel 126 of the sighting device 100. In some embodiments, the lateral adjustment screw 304 may also extend at least partially into the lateral adjustment aperture 218*b*, although it need not do so. In some cases, for instance, the lateral adjustment aperture 218*b* is a pilot hole. Optionally, a pilot hole may have a rod or bar positioned therein and extending into the sighting device 100, although in other embodiments there may be nothing within the pilot hole, the pilot hole may be omitted, or the lateral adjustment screw 204 may extend into the pilot hole. In some embodiments, the lateral adjustment aperture 218*a* and/or the lateral adjustment channel 126 are female threaded connectors having internal threads for engaging threads of the lateral adjustment screw 204, which is representative of any suitable male threaded connector. For instance, as discussed herein, the lateral adjustment aperture 218*a* and the lateral adjustment channel 126 may have threads that are optionally of differing coarseness. In such an embodiment, the lateral adjustment screw 204 may be a complex screw, such that along a length of the lateral adjustment screw 204, there are threads having differing coarseness. FIG. 3B illustrates an example lateral adjustment screw 204 with two sections of threads having differing coarseness. The amount by which the coarseness varies may be changed in any suitable manner. Moreover, in some embodiments, the lateral adjustment screw 204 may have threads of a single coarseness.

As discussed herein, one aspect of the present disclosure is that adjustment can be made to a sighting device such as sighting device 100 within the optical sighting assembly 300 of FIGS. 3A and 3B. According to one embodiment, the adjustment allows an optical component 140 and a reticle 150 to be adjusted to accurately sight a device to which assembly 300 corresponds.

Therefore, according to one embodiment, the sighting assembly 300 may include an optional lateral adjustment mechanism and/or a vertical adjustment mechanism. A more particular example of suitable lateral and/or vertical adjustment mechanisms will be described with reference to FIG. 3B.

For instance, as best shown in FIG. 3B, the sight mount 200 may include one or more vertical adjustment seats 220, 222, and one or more lateral adjustment openings 214, 216. Vertical adjustment seats 220, 222 may have a position corresponding to a position of vertical adjustment seats 120, 122 (FIG. 1B) of the sighting device 100. One or more biasing members 306 may be positioned between the sighting device vertical adjustments seats 120, 122 and the sight mount vertical adjustment seats 220, 222. In the illustrated embodiment, for instance, the biasing members 306 are shown as springs, although any suitable biasing mechanism may be used. According to one aspect, the biasing members 306 may act to exert a vertical separation force on the sighting device 100 and the sight mount 200.

In some embodiments, an adjustment mechanism may be provided to counteract or offset the biasing force of the vertical biasing members 306. In the illustrated embodiment, for instance, the vertical adjustment screw 308 may couple the sighting device 100 to the sight mount 200. As the vertical adjustment screw 308 engages the sighting device 100 and the sight mount 200, a force may be exerted that places the biasing members 306 in a stressed state, and which maintains the biasing members 306 in the stressed state while the sighting device 100 remains relatively stationary in a vertical position relative to the sight mount 200. In some embodiments, the sighting device 100 and/or the sight mount 200 include threads to engage the vertical adjustment screw 308. In the example described herein, in which deviation at the sighting device of even 0.001" can cause a 4.5" deviation for each 100 yards, very fine adjustments to the sighting device 100 can provide significant increases in accuracy across a wide range of distances.

Similar to the operation of the vertical biasing members 306, one or more lateral biasing members 302 may also be used to bias the sighting device 100 relative to the sight mount 200. In FIG. 3B, for instance, two lateral biasing members 302 may be positioned against a side surface or in seats within the sighting device 100, and against the sight mount 200. For instance, the lateral biasing members 302 may engage an internal side surface of the sight mount 200. In another embodiment, the lateral biasing members 302 may be positioned within lateral adjustment openings 214, 216 of the sight mount 200. In such an embodiment, one or more set screws 303 are optionally also positioned within and/or secured to the openings 214, 216, to place the lateral biasing members 302 in a stressed state. Optionally, a lateral adjustment screw 304 may also couple the sighting device 100 to the sight mount 200. As the lateral adjustment screw 304 engages the sighting device 100 and the sight mount 200, a force may be exerted that places the biasing members 302 in a stressed state, or changes the stressed state of the biasing members 302, and which maintains the biasing members 302 in the stressed state while the sighting device 100 remains relatively stationary in a lateral direction relative to the sight mount 200. In some embodiments, the sighting device 100 and/or the sight mount 200 include threads to engage the lateral adjustment screw 304.

In operation, the lateral adjustment screw 304, the lateral biasing members 302, and the threaded connections of the sighting device 100 and/or sight mount 200 may act as a lateral adjustment mechanism. By way of illustration, and with reference to FIG. 3A, as the lateral adjustment screw 304 is tightened or loosened, the force counteracting the biasing members 302 may be changed, thereby allowing the biasing members 302 to expand or contract. As the biasing members 302 expand or contract, the sighting device 100 may also move within the sighting chamber in the sight mount 200. For instance, the threads on the lateral adjustment screw 304, sight mount 200, and/or sighting device 100 may be sufficiently fine that very small amounts of adjustment may be realized.

In some embodiments, even finer amounts of adjustment may be desired. Therefore, according to one embodiment, an adjustment mechanism may include micro-adjustment mechanisms. For instance, in the context of the lateral adjustment mechanism in FIG. 3A, a micro-adjustment mechanism may further be realized by, at least in part, varying the threads in the sighting device 100 and/or the sight mount 200. For instance, as discussed herein, the lateral adjustment screw 304 may engage threads on both the sight mount 200 and the sighting device 100. In accordance with at least one aspect of the present disclosure, the thread coarseness of the threads in the sight mount 200 may vary from the coarseness of the threads in the sighting device 100.

In embodiments in which the thread coarseness of the sight mount 200 do not match the thread coarseness of the sighting device, even finer lateral adjustment may be obtained in some embodiments. For instance, as the lateral adjustment screw 306 is tightened or loosened, the relative movement of the sighting assembly 100 may be less than the overall pitch of the threads on the lateral adjustment screw 306. In particular, due to the difference of the thread coarseness in the sighting device 100 and the sight mount 200, the sighting assembly 100 may move only the difference between the pitch of the sight mount 200 and the sighting assembly 100. Thus, with rotational movement of the lateral adjustment screw 306, a very fine, and potentially micro-level of lateral adjustment may be obtained.

In some embodiments, the lateral adjustment mechanism may also include additional or alternative aspects or components. In FIG. 3A, for instance, the lateral adjustment mechanism may further include one or more braces 212 at or near a proximal end of the sight mount 200. For instance, in the illustrated embodiment, the sighting chamber in which the sighting device 100 is situated, has a width generally larger than the width of the sighting device 100 therein, such that some amount of play is provided, and lateral adjustment of the sighting device 100 is enabled. At the distal end of the sight mount 200, however, the braces 212 may extend inward from the interior walls defining the sighting chamber. The braces 212 in FIG. 3A, for instance, extend inward to define a more narrow passage. The more narrow passage may, for instance, have a width generally corresponding to the width of the corresponding portion of the body 102 of the sighting device 100.

The braces 212 may provide any number of features or aspects. According to one aspect, as the lateral adjustment mechanism is employed, the distal end of the sighting device 100 may move laterally within the sight mount 200, with such movement facilitated by the biasing members 202 or in a manner that further stresses the biasing members 202. In FIG. 3A, the biasing members 202 are shown as being on a single side of the sighting device 100. By employing the two braces 212, the forces of the biasing members 202 that may tend to push the sighting device 100 towards an opposing side are at least partially counteracted. In other words, the braces 212 retain the proximal end of the sighting device 100 at a generally consistent frame of reference. In this embodiment, the braces 212 cooperate to maintain the proximal end of the sighting device centered relative to the sight mount 200.

As will be appreciated in view of the disclosure herein, an exemplary vertical adjustment mechanism may operate in a manner generally similar to the lateral adjustment mechanism previously described. For instance, in FIG. 3B, two vertical biasing members 306 may be positioned between the sight mount 200 and the sighting device 100. The biasing members 306, in cooperation with the vertical adjustment screw 308, and optionally threading on the sighting device 100 and/or sight mount 200 may act as the vertical adjustment mechanism. For instance, as discussed previously, the vertical adjustment screw may be tightened or loosened and, in response, the vertical biasing members 306 may expand or contract, thereby also causing the sighting device 100 to move vertically relative to the sight mount 200. In some embodiments, the sighting device 100 and the sight mount 200 may each include threads to engage the vertical adjustment screw 308. The threads of the sighting device 100 and the sight mount 200 may be the same or different. Where different, adjustment may be made on the basis of differences in pitch between the threads of the sighting device 100 and the sight mount 200, rather than based directly on the pitch of the vertical adjustment screw 308.

While embodiments described herein generally illustrate an example embodiment in which four biasing members 302, 306 may be used to facilitate adjustment of the sighting device, it should be appreciated that this is merely exemplary. In some embodiments, more or fewer than four biasing members (e.g., more or less than two vertical and/or two lateral biasing members) may be used. In some embodiments, the biasing members 306, 306 may also act as stabilizing members. For instance, where even 0.0005" variation can cause a shot to be off target the four-way spring loaded embodiment may provide stabilization to maintain the sighting device in a desired orientation and adjustment status.

Figure 4:
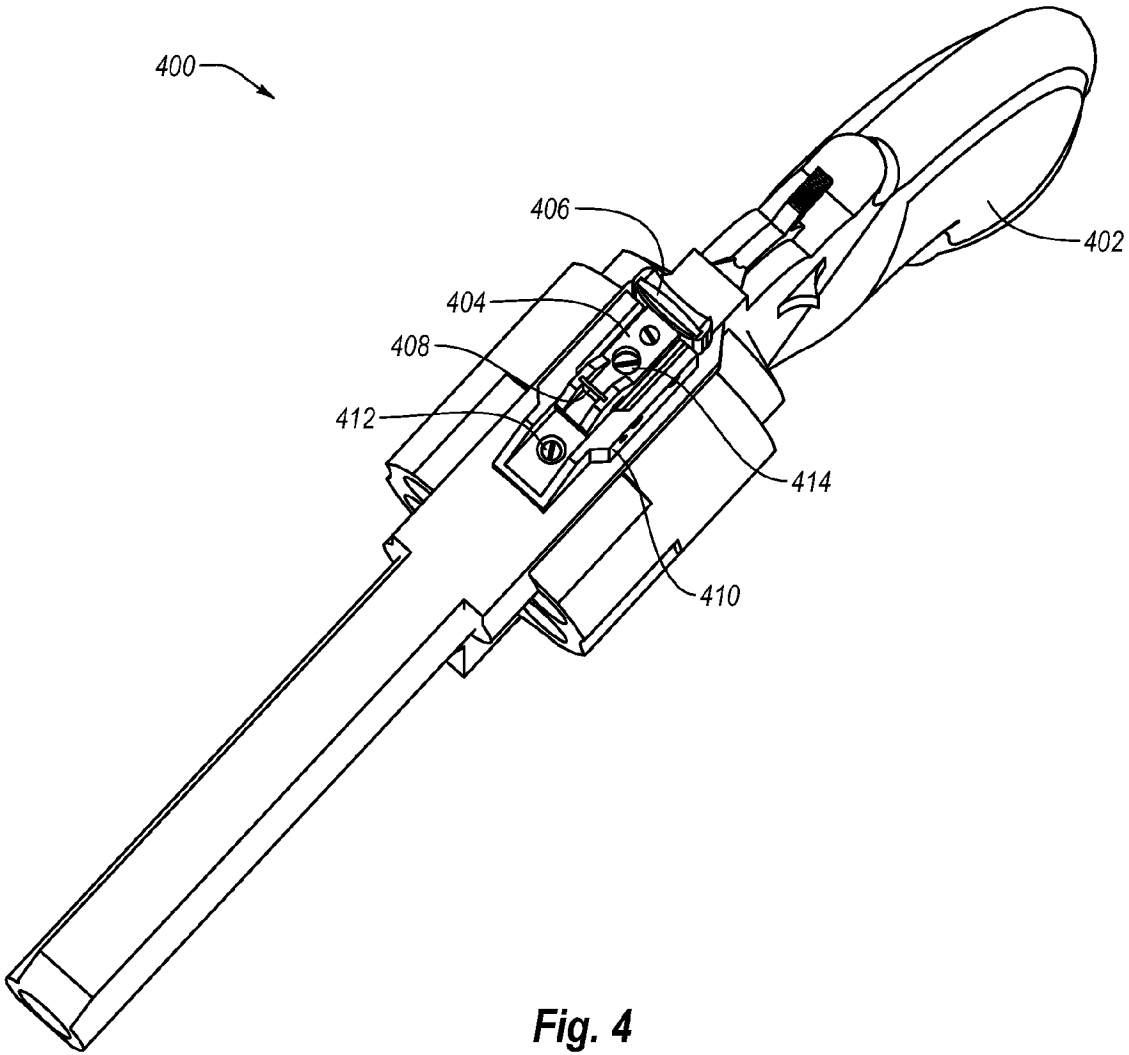
FIG. 4 illustrates an exemplary use of the various embodiments of the sights disclosed herein, such as in connection with a gun.

Turning now to FIG. 4, an exemplary environment 4 is illustrated and depicts an exemplary use of an optical sighting assembly as described herein. In the illustrated embodiment, for instance, a revolver 402 is illustrated and exemplifies any of a number of types of devices with which an optical sighting assembly according to the present disclosure may be used. For instance, in other environments, an optical sighting assembly may be used with other types of handguns, with rifles, with an archery bow, with a transit or theodolite, or in any other suitable application.

In the illustrated embodiment, the revolver 402 is coupled to an optical sighting assembly that includes a sighting device 404 mounted to a sight mount 410. In this embodiment, the sighting device 404 includes an optical component 406 configured to at least partially magnify a reticle 408 also mounted to the sighting device 404 and/or the sight mount 410.

As further illustrated in FIG. 4, the sight mount 410 may be integral with the revolver 402 or may be separable therefrom. More particularly, a manufacturer of the revolver 402 may, upon manufacture of the revolver 402, intend that a sight assembly 404 of the present disclosure be incorporated therewith. To that end, the sight mount 410 may be integrally manufactured as part of the revolver 402. In such an embodiment, the user may not need to separately attach the sight mount 410. Further in such embodiments, various additional or alternative aspects may also be realized. For instance, as described previously, lateral and/or vertical adjustment mechanisms may be employed in connection with some embodiments of the present application. In the case of a vertical adjustment mechanism, a biasing or other adjustment mechanism may act against the revolver directly, rather than against a surface of the sight mount 410.

Although the sight mount 410 may be machined into or otherwise integrally formed with the revolver 402, this is also merely exemplary. In other embodiments, the sight mount 410 may be selectively secured to the revolver. For instance, FIG. 4 illustrates optional fasteners 412, 414 that may secure the sighting device 404 and/or sight mount 410 to the revolver 402. In other embodiments, however, other types of fastening or securement mechanisms may be employed. By way of illustration, the sight mount 410 may be brazed, soldered, or welded to the revolver 402. In still other embodiments, another type of mechanical fastener may be used. For instance, a dovetail joint may be formed to connect the sight mount to the revolver 402. In one example embodiment, a pin extends from the revolver 402 while one or more correspondingly shaped tails are formed in the sight mount 410. Accordingly, the sight mount 410 may be slid onto and interlocked with the revolver 410. The foregoing is merely exemplary and any suitable mechanical or other fastener may be used to permanently or releasably secure the sight mount 410 to the revolver 402.

Figure 5:
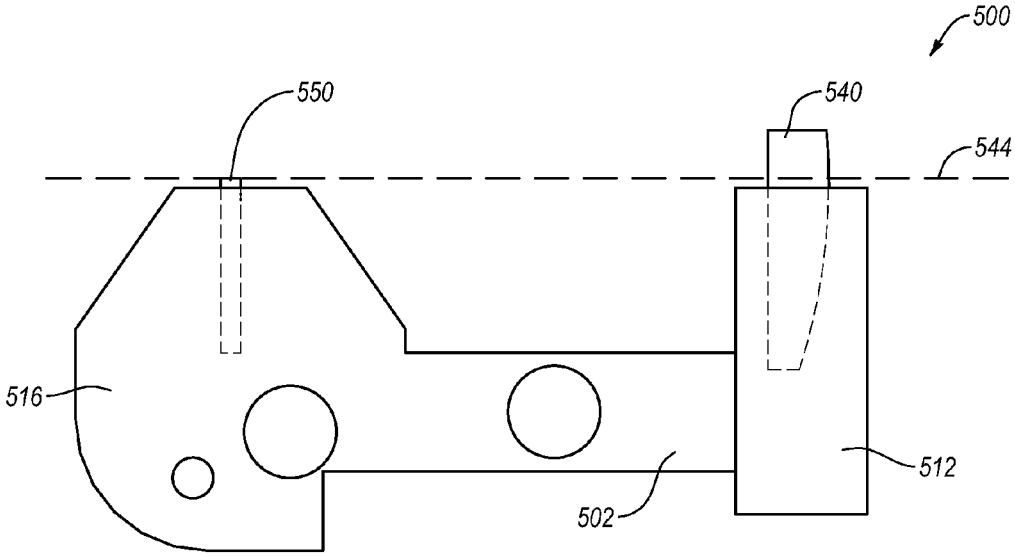
FIG. 5 illustrates a side view of an alternative embodiment of a sight according to another aspect of the disclosure, and includes an optical component extending vertically beyond the reticle.

Referring now to FIG. 5, an alternative embodiment of a sighting device 500 according to some aspects of the present disclosure is illustrated and described. As shown in FIG. 5, the exemplary sighting device 500 may include an optical component 540 that is at least partially secured in place using an optical support 540. Additionally, or alternatively, the exemplary sighting device 500 may include a reticle 550 at least partially secured using a reticle mount 516. The reticle mount 516 and/or optical support 512 may be separated by a body 502, although the reticle mount 516 and the optical support 512 may also be considered to form at least a portion of the body of the sighting device 500.

In various regards, the sighting device 500 of FIG. 5 is similar to the sighting device 100 previously described with reference to FIG. 1. In some aspects, however, the sighting device 500 has been varied from those previously illustrated and/or described. For instance, in FIG. 5, the reticle 550 is only partially mounted within the reticle mount 516. More particularly, as shown in FIG. 5, the reticle extends vertically upward relative to the reticle mount 516, such that an upper surface of the reticle 550 is external to, and above in the illustrated orientation, the reticle mount 516.

Similarly, the optical component 540 is further illustrated as extending above and external to the optical support 512. According to another aspect, the optical component 540 may also be a lens, but may vary from the optical component 140 in FIGS. 1A-1D. For instance, in the illustrated embodiment, a line 544 illustrates a longitudinal axis extending through a center of the lens of the optical component 540. In such an embodiment, the optical component 540 may be, in some embodiments, cut above center so as to be larger than a half-lens. In other embodiments, however, the optical component 540 may be smaller than a half-lens but nonetheless be cut above center. For instance, the optical component 540 may be segmented to have an hourglass shape extending above center, but nonetheless have less than half the volume of a full lens. While the above description relates to a lens that is cut, it should be appreciated that such description does not necessarily require that a full lens be produced and cut in a manufacturing process. While such a process may be used, in other embodiments, a lens is molded to a particular shape. Accordingly, an optical component described herein as being cut above center includes optics molded, cut, or otherwise formed to have a configuration as described and/or illustrated herein.

A lens cut above center, or otherwise formed to extend above center, may be desirable in some instances and provide advantages beyond those offered by a lens or other optical component cut at or below the center. For instance, when cut at center, a lens may have a top surface generally aligned with a top surface of the reticle 550. As the sighting device 500 is used to target objects, the range may vary. As the range increases, the reticle 540 may extend into the field of view, thereby blocking a view of a target at a particular range. In contrast, if the lens or other optical component 540 is cut above center, or otherwise positioned above the reticle 550, the reticle 550 can be positioned further out of the field of view. In particular, while the reticle 550 may obstruct a portion of the field of view, a target can be identified at an increased range before the reticle 550 obstructs the target. Such a lens may thus project the reticle 550 higher than an actual position of the reticle 550. Consequently, the line of sight looks over the reticle 550 without infringing on the line of sight.

To allow for increased range without obstruction, the optical component 540 may be positioned in any number of different manners. For instance, in one example embodiment, the top surface of the optical component 540 is positioned between 0.01 and 0.06 inches above the reticle 550. For instance, according to one embodiment, the top surface of the optical component 540 may be positioned between about 0.02 and about 0.04 inches above the top surface of the reticle 550. In other embodiments, the top surface of the optical component 540 may be positioned less than 0.01 inches or more than 0.06 inches above the reticle 550. As noted previously, in some cases, the optical component 540 may be cut above center (e.g., by an amount between about 0.01 and about 0.06 inches), or the optical component 540 may be simply positioned above the reticle 550.

Figure 6:
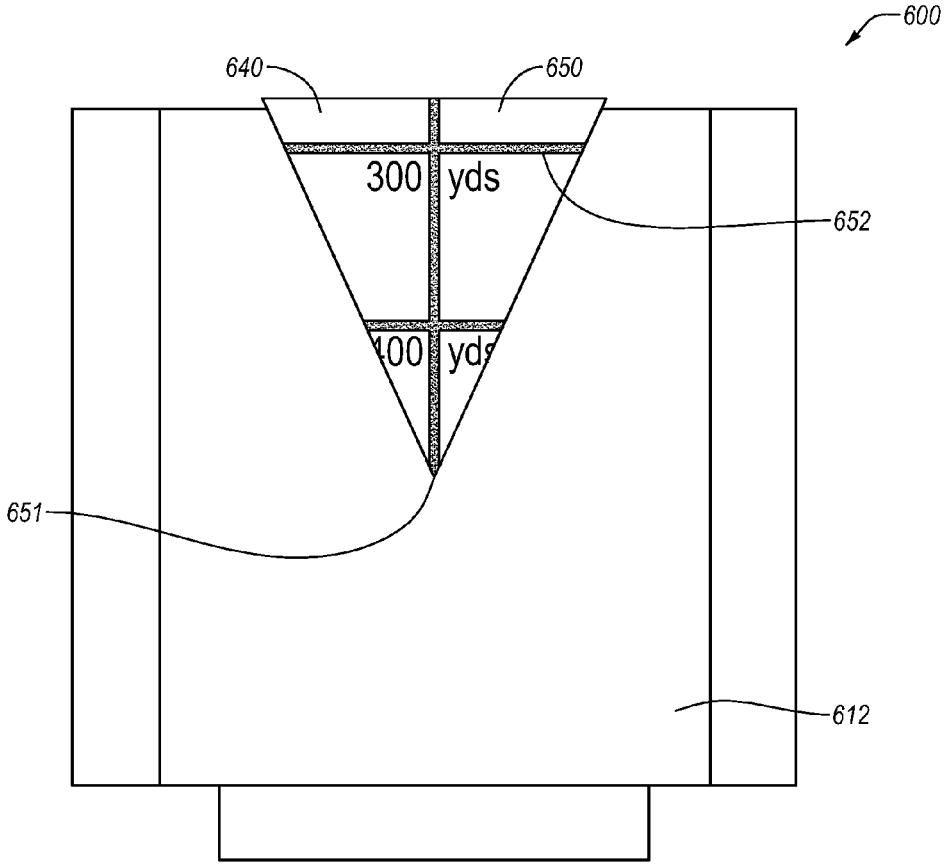
FIG. 6 illustrates a frontal view of an alternative embodiment of a gun sight according to another aspect of the disclosure, and includes a generally triangular optical component.

With reference now to FIG. 6, another alternative example of a suitable optical sighting device 600 is illustrated according to another embodiment of the present disclosure. As noted herein, an optical sighting device 600 may include an optical component 640 secured by an optical support 612, as well as a reticle 650 magnified by the optical component 640. As further described herein, the optical component 640 may take any number of different shapes. For instance, the optical component 640 may be semi-circular, may be cut above center to be larger than semi-circular, or may have other shapes.

In FIG. 6, for instance, an optical component 640 of a particular shape is illustrated in further detail. In particular, in the illustrated embodiment, the optical component 640 may include a lens or other optic having a generally triangular shape. In the illustrated embodiment, for instance, the generally triangular optical component 640 has a generally flat upper surface positioned slightly above the optical support 612, and extends at an angle downward, to a lower tip 641 that is approximately centered within the optical support 612. While FIG. 6 illustrates the generally flat upper surface of the triangular optical component 640 slightly above the optical support 612, this is merely exemplary. In other embodiments, the optical component 640 and/or reticle 650 may be positioned below or within the optical support 612. For instance, the generally flat upper surface of the optical component 640 may be aligned to be vertically below the upper surface of the optical support 612.

One feature of the generally triangular optical component 640 according to the present embodiment is that it may help to reduce parallax. Broadly stated, parallax relates to the apparent movement of objects within the field of view in relation to the reticle 650. As it relates to the embodiments herein, parallax may occur where the vertical bar of reticle indicia 652 is out of central alignment within the optical component 640, thereby reducing accuracy. As shown in FIG. 6, the generally triangular shape of the optical component 640 may assist in aligning the indicia 652 so that it is properly centered within the lens 640. More particularly, as the optical component 640 can downward and to the bottom tip 641 which may be centered within the optical component 640. The tip 641 provides a point at which the central axis of the optical component 640 is known. Accordingly, by aligning the vertical bar of the indicia 652 with the tip 641, the user can align the indicia 652 to have a very small amount of error.

The foregoing detailed description makes reference to specific exemplary embodiments. However, it will be appreciated that various modifications and changes can be made without departing from the scope contemplated herein and as set forth in the appended claims. For example, various optical sighting devices and components may have different combinations of sizes, shapes, configurations, features, and the like. Such differences described herein are provided primarily to illustrate that there exist a number of different manners in which optical sighting devices may be used, made, and modified within the scope of this disclosure. Different features have also been combined in some embodiments to reduce the illustrations required, and are not intended to indicate that certain features are only compatible with other features. Thus, unless a feature is expressly indicated to be used only in connection with one or more other features, such features can be used interchangeably on any embodiment disclosed herein or modified in accordance with the scope of the present disclosure. The detailed description and accompanying drawings are thus to be regarded as merely illustrative, rather than as restrictive, and all such modifications or changes, if any, are intended to fall within the scope of this disclosure.

More specifically, while illustrative exemplary embodiments in this disclosure have been more particularly described, the present disclosure is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description, which examples are to be construed as non-exclusive. Moreover, any steps recited in any method or process described herein and/or recited in the claims may be executed in any order and are not limited to the order presented in the claims, unless otherwise stated in the claims. Accordingly, the scope of the invention should be determined solely by the appended claims and their legal equivalents, rather than by the descriptions and examples given above.

What is claimed is:

1. A sighting device, comprising:

a segmented optic;

a reticle optically aligned with said segmented optic, wherein said segmented optic is configured to magnify said reticle;

a body structure supporting said segmented optic and said reticle, wherein said segmented optic and said reticle are supported to define an open sight configuration; and an adjustment mechanism coupled to said body structure, said adjustment mechanism comprising:

two threaded openings, wherein threads of said two threaded openings have different coarsenesses; and a threaded fastener positioned within said two threaded openings.

2. The sighting device recited in claim 1, wherein said segmented optic is semi-circular.

3. The sighting device recited in claim 1, wherein said segmented optic is cut above center.

4. The sighting device recited in claim 1, wherein said segmented optic is shaped as: a triangle, pie shape, or wedge.

5. The sighting device recited in claim 1, further comprising a base coupled to said body structure.

6. The sighting device recited in claim 1, wherein said reticle comprises a transparent body.

7. The sighting device recited in claim 1, wherein said adjustment mechanism is configured to adjust vertical and horizontal positions of at least said segmented optic.

8. The sighting device recited in claim 1, wherein said reticle comprises a plurality of different distance indicia.

9. The sighting device recited in claim 1, wherein said reticle is adapted to block a field of view when viewed through said segmented optic.

10. A segmented optic sighting device, comprising:

a support structure;

a reticle coupled to a rear end of said support structure, wherein said reticle comprises:

a transparent body having a plurality of different opaque distance indicia thereon, a front surface, and a contrast component;

a segmented optic coupled near a front end of said support structure, said segmented optic having a top planar surface that is oriented perpendicular to said front surface of said reticle;

wherein said support structure supports said segmented optic and said reticle such that said reticle is aligned with said segmented optic for magnification of said plurality of different distance indicia when viewed through said segmented optic; and wherein said support structure is adapted to position said segmented optic in an open sight configuration relative to said reticle.

11. The segmented optic sighting device recited in claim 10, wherein said contrast component includes a fiber optic component.

12. The segmented optic sighting device recited in claim 11, wherein said fiber optic component is a light transmitting component configured to transmit light to an edge thereof.

13. The segmented optic sighting device recited in claim 11, wherein said fiber optic component is formed from an end of a round fiber or an edge of a flat fiber.

14. The segmented optic sighting device recited in claim 10, wherein said segmented optic is semi-circular.

15. The segmented optic sighting device recited in claim 14, wherein said segmented optic is cut above center.

16. A sighting device, comprising:

a support structure having a first end and an opposing second end;

a reticle coupled to said first end of said support structure, said reticle having a front surface and an upper surface opposite said support structure; and a segmented optic component coupled to said second end of said support structure, said segmented optic component having a planar upper surface opposite said support structure, said upper surface of said segmented optic component extending perpendicularly to said front surface of said reticle, wherein:

said upper surface of said segmented optic component is positioned a first distance from said support structure;

said upper surface of said reticle is positioned a second distance from said support surface, said first distance being greater than said second distance;

said segmented optic component comprises an optical center line extending through a thickest point of said segmented optic component, said segmented optic component further including a first thinner portion above said thickest portion, and a second thinner portion below said thickest portion;

said reticle is selectively positionable relative to said segmented optic for magnification of said reticle when viewed through said segmented optic component; and wherein said support structure defines an open sight configuration for said reticle and said segmented optic component.

17. The sighting device recited in claim 16, wherein said support structure is adjustable to modify at least one of a vertical or horizontal position of said segmented optic component.

18. The sighting device recited in claim 16, wherein said segmented optic component is configured to project said reticle higher than an actual position of said reticle.

19. The sighting device recited in claim 16, wherein said reticle comprises a transparent body.

20. The sighting device recited in claim 19, wherein said reticle further comprises opaque distance indicia thereon.

* * * * *